United States Patent [19]

Fenton et al.

[11] 3,982,571

[45] Sept. 28, 1976

[54] VAPOUR RECOVERY NOZZLE WITH MECHANICAL FLOW INTERLOCK

[75] Inventors: David T. Fenton, Madison, Ohio; Leonard W. Swain, London, Canada

[73] Assignee: Emco Wheaton Inc., Conneaut, Ohio

[22] Filed: May 16, 1975

[21] Appl. No.: 578,044

[52] U.S. Cl. ..... 141/225; 141/207; 141/292

[51] Int. Cl.[2] ..... B65B 39/04

[58] Field of Search ..... 222/52; 141/207, 208, 141/193, 225, 292

[56] References Cited

UNITED STATES PATENTS

| | | | |
|---|---|---|---|
| 2,547,690 | 4/1951 | Chadil et al. | 141/207 |
| 2,867,249 | 1/1959 | Denlinger | 141/208 |
| 3,710,831 | 1/1973 | Riegel | 141/207 |
| 3,719,215 | 3/1973 | Murray | 141/207 |

*Primary Examiner*—Allen N. Knowles
*Assistant Examiner*—Hadd Lane
*Attorney, Agent, or Firm*—Roy H. Saffrey; Gordon W. Hodson

[57] ABSTRACT

In a dispenser nozzle having, a main body portion, a filling tube projecting from one end of said main body portion, and a liquid flow passage extending through said main body and said filling tube, the filling tube being adapted to be located within the open end of a neck of a fuel storage tank of a vehicle or the like, a control valve mechanism for controlling the flow of liquid through said liquid flow passage, said mechanism including a valve operating mechanism and latching means for releasably engaging said valve operating mechanism to render said valve operating mechanism operative when engaged by said latching mechanism and inoperative when released by said latching mechanism, the improvement of sensor means mounted on said nozzle and disposed adjacent said filling tube, said sensor means communicating with said latch means to release said latch means with respect to said valve operating mechanism to render said valve operating mechanism inoperative when said filling tube is now disposed in a predetermined operative relationship within a fuel storage tank, said sensor means cooperating with said fuel storage tank when said filling tube is located in a predetermined operative relationship with respect to a fuel storage tank to permit said latch means to move to a position to engage said valve operating mechanism to render said valve operating mechanism operative to permit the flow of liquid through said liquid flow passage into said tank.

1 Claim, 6 Drawing Figures

26
30
32
40
18
44
36
46
34
42
28
76
58
60
22
3
72
37
24
70
79
74
12
10
20
16
52
56
62
63
78
50
54
14
64
66

VAPOUR RECOVERY NOZZLE WITH MECHANICAL FLOW INTERLOCK

FIELD OF INVENTION

This invention relates to dispenser nozzles of the type used for conveying liquid fuels to the fuel storage tanks of vehicles or the like. In particular this invention relates to a nozzle having a mechanism for ensuring that the filling tube is correctly located within the neck of the fuel tank which is to be filled.

PRIOR ART

Self-service gasoline stations are becoming increasingly common and a number of difficulties are being experienced because of the improper use of the nozzles presently available for controlling the flow of gasoline to the gasoline storage tanks of the automobiles. In many instances there is a tendency for the unskilled operator to remove the nozzle from its mounting and to immediately depress the manually locatable handle. This results in an immediate discharge of gasoline from the nozzle which pollutes the surrounding environment and may cause injury to the operator.

The present invention overcomes this difficulty by providing a structure which prevents opening of the flow control valve until the filling tube of the nozzle is correctly located within the neck of the fuel storage tank of the vehicle.

In order to reduce environmental pollution, nozzles have been designed which incorporate a vapour recovery system. However, the operators of the nozzles incorporating the vapour recovery system again require some basic understanding of the overall system. It is difficult to educate the public as a whole in the use of nozzles incorporating the known vapour recovery systems, with the result that there is a likelihood that many of the systems may be inoperative by reason of the fact that their operation is not fully understood by the users.

The present invention overcomes this difficulty by integrating the liquid flow valve control mechanism with the vapour recovery mechanism to ensure that the liquid flow control valve cannot be opened until the vapour recovery mechanism is operatively located with respect to the tank from which vapours are to be recovered during the filling of the tank.

Automatic nozzles are presently available such as that described in U.S. Pat. No. 3,196,908 which includes a latching mechanism which is operated by a flexible diaphragm to render the manually operable control mechanism inoperative when the level of liquid in the storage tank rises above a predetermined level. A second system incorporating a second diaphragm is described in U.S. Pat. No. 3,771,577. This mechanism is operative in response to an increase in pressure in the vapour recovery line above a predetermined maximum pressure to again activate the latching mechanism to render the manual control mechanism inoperative. The mechanism does not, however, include any structure which ensures the correct operation of the vapour recovery system and it is possible to operate the manually engageable handle to open the liquid flow valve when the nozzle is not operatively located with respect to the tank which is to be filled. The latching mechanism is normally disposed in the position locking the manual control mechanism in a position in which it is operative whereas in a device of the present invention the automatic control mechanism is rendered inoperative when the nozzle is not in use.

SUMMARY OF INVENTION

According to an embodiment of the present invention, there is provided in a dispenser nozzle for dispensing liquid into the fuel storage tank of a vehicle or the like having a main body portion, a filling tube projecting from one end of the main body portion, and a liquid flow passage extending through the main body portion and the filling tube, the filling tube being adapted to be located within the open end of a neck of a fuel storage tank of a vehicle or the like, a control valve mechanism for controlling the flow of liquid through the liquid flow passage, the mechanism including a valve operating mechanism and latching means for releasably engaging the valve operating mechanism to render the valve operating mechanism operative when engaged by said latching mechanism and inoperative when released by said latching mechanism, the improvement of sensor means mounted on the nozzle and disposed adjacent the filling tube, the sensor means communicating with the latching means to release the latching means with respect to the valve operating mechanism to render the valve operating mechanism inoperative when the filling tube is not disposed in a predetermined operative relationship with respect to a fuel storage tank, the sensor means cooperating with the fuel storage tank when the filling tube is located in a predetermined operative position with respect to a fuel storage tank to permit the latching means to move to a position to engage the valve operating mechanism to render the valve operating mechanism operative to permit the flow of liquid through the liquid flow passage into the tank.

PREFERRED EMBODIMENT

The invention will be more clearly understood after reference to the following detailed specification read in conjunction with the drawings wherein FIG. 1 is a partially sectioned side view of a nozzle according to an embodiment of the present invention;

The present invention relates to nozzles of the type described in U.S. Pat. Nos. 3,196,908 and 3,771,577 and the nozzle described in copending U.S. patent application Ser. No. 542,857. Each of the nozzles described in the prior patents and prior patent application is capable of modification or adaptation to include the additional control mechanism which is the subject of the present invention. The additional control mechanism of the present invention is shown as being incorporated in a nozzle which includes two oppositely disposed diaphragm chambers, one of which is operative to release the latching mechanism in response to a signal indicating that the level of liquid in the storage tank has risen above a predetermined level and the other is operative in response to a signal indicating that the pressure in the vapour recovery system has exceeded a predetermined pressure. In both instances the diaphragms serve to locate the latching mechanism in the position rendering the manual control mechanism operative when the nozzle is not in use; i.e., if the nozzle of the prior patents was removed from its storage position at the pump, the operator could immediately operate the manual control valve to discharge liquid through the nozzle whether or not the nozzle is correctly located within the filling neck of the tank which is to be filled.

Figures 1, 2, 3:
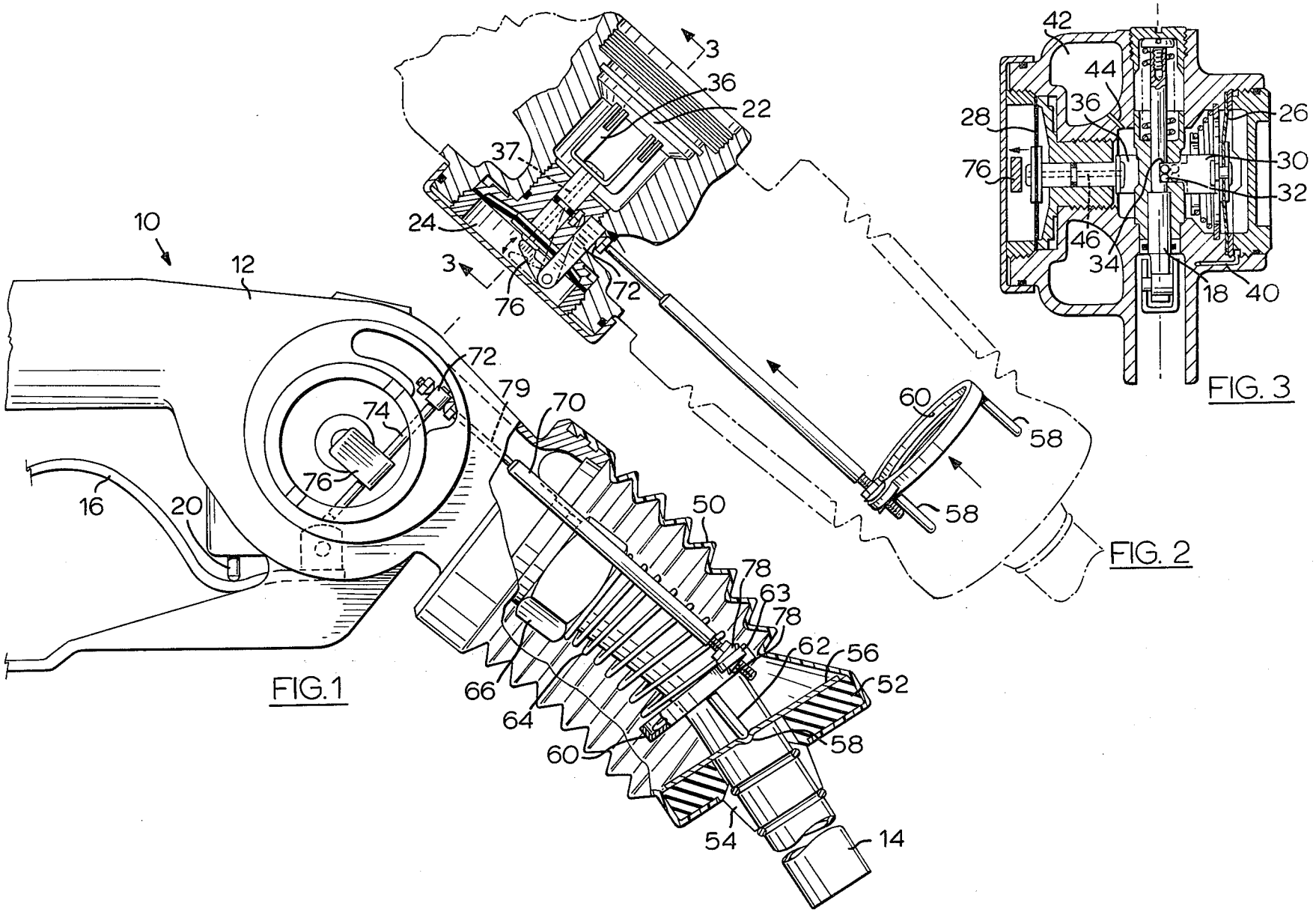
FIG. 2 is a partially sectioned top view of a nozzle according to a further embodiment of the present invention.
FIG. 3 is a sectional view taken along the line 3—3 of FIG. 2.

With reference to FIG. 1 of the drawings, the reference numeral 10 refers generally to a nozzle according to an embodiment of the present invention. The nozzle includes a main body portion 12 and a filling tube 14 which extends from one end of the main body portion 12. A manually engageable handle 16 is pivotally mounted on the end of a plunger 18 and is operative to raise and lower the stem 20 of the main control valve in the manner described in the prior patents listed above. The main body portion is formed with a vacuum diaphragm chamber 22 and a vapour recovery pressure chamber 24. Diaphragms 26 and 28 are mounted within the chambers 22 and 24 respectively. The diaphragm 26 has an arm 30 upon which a pair of rollers 32 are mounted for movement into and out of engagement with slot 34 formed on plunger 18. The rollers 32 are also engageable by a pusher arm 36 which is mounted on the diaphragm 28. In operation, an interruption in the vacuum passage communicating between the vacuum chamber of the vacuum diaphragm 26 causes the vacuum diaphragm 26 to move to a position in which the rollers 32 are withdrawn from the slot 34 releasing the plunger 18 to render the manual control valve mechanism inoperative. Similarly, an increase in pressure in the vapour recovery passage means is communicated to the vapour recovery diaphragm to cause the vapour recovery diaphragm to move towards the plunger mechanism and thereby push the rollers 32 out of engagement with the slot 34, releasing the plunger 18. This is substantially the same mechanism described in U.S. Pat. No. 3,771,577. The diaphragm 26 is operated in response to variations in the vacuum generated by the conventional venturi mechanism conveyed to the vacuum chamber by way of passage 40. The diaphragm 28 is operated in response to the pressure in the vapour recovery passages 42 which are communicated to the vapour recovery diaphragm chamber by way of pressure 44 and 46. Again, this structure is as described and disclosed in U.S. patent application Ser. No. 542,857.

An expandable vapour recovery shroud 50 is mounted at one end of the main body portion 12 and extends to an annular sealing ring 52 which is located at the outer end of the shroud. An annular seat 54 is mounted on the filling tube 14 and the sealing ring 52 engages the seat 54 when the shroud is in its extended position which is the normal position which the shroud assumes when the nozzle is not in use. The annular ring 52 is preferably made from a resilient material and has an annular backing plate 56 of sheet metal or the like into which two shallow depressions 58 are formed. Only one of the depressions 58 is shown in FIG. 1 of the drawings but it will be understood that the second depression is located diametrically opposite the first depression. An annular collar 60 extends around the filling tube 14 and has a pair of pins 62 projecting forwardly therefrom into engagement with the recesses 58 in the plate 56. A coil spring 64 extends between the collar 60 and the clamping nut 66 which serves to secure the filling tube 14 with respect to the body 10. The compression spring 64 normally urges the collar in a direction towards the discharge end of the filling tube 14 and the collar in turn urges the annular sealing ring 52 towards the seat 54 by means of the pins 62. The mounting of the pins 62 in the shallow recesses 58 permits the sealing ring 52 to be aligned with respect to the seat 54 despite the fact that to do so it is necessary to angularly incline the sealing ring 52 with respect to the axis of the pin 62.

Figure 5:
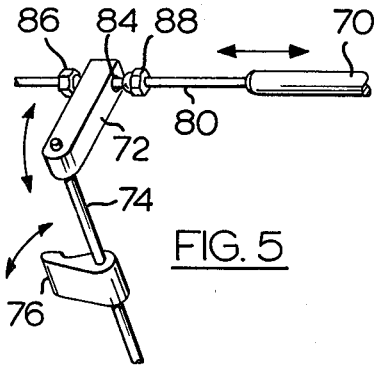
FIG. 5 is a detail view of the linkage used to render the valve operating mechanism inoperative.

Accordingly to one embodiment of the present invention the addition control mechanism for controlling the position of the latching rollers 34 consists of a connecting rod 70, lever arm 72, shaft 74 and lever arm 76. One end of the connecting rod 70 is mounted in a lug 63 which is an integral part of the collar 60. The passage in the lug 63 is larger in diameter than the end of connecting rod 70 and a resilient bush 78 is located within the lug 63 to accommodate the misalignment of the connecting rod 70 with respect to the passage formed in the lug 63. The connecting rod 70 has a portion 79 at the inner end thereof which passes through a passage 84 formed in the arm 72 (FIG. 5) and which is secured with respect to the arm 82 by means of clamping nuts 86 and 88 which are threadably mounted on the portion 79 of the connecting rod 70. The arm 72 is rigidly secured with respect to the shaft 74. The shaft 74 is mounted for rotation in the threaded diaphragm ring which is mounted in the main body. The arm 76 is rigidly secured with respect to the shaft 74. The inner end of the arm 76 is adapted to engage the head of the shaft 37 upon which the pusher arm 36 is mounted.

Figure 4:
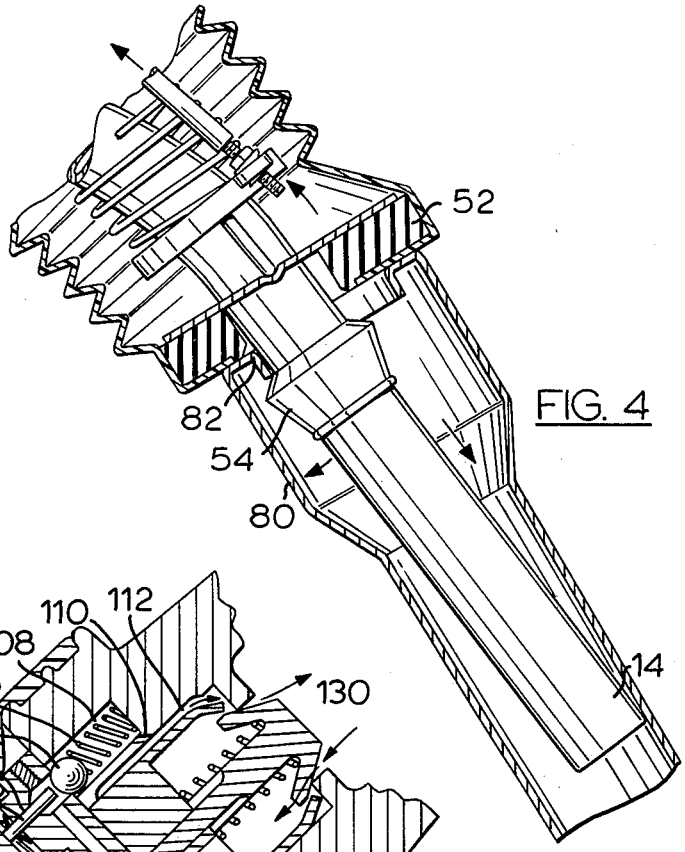
FIG. 4 is a partially sectioned side view similar to a portion of FIGS. 1 illustrating the manner in which the nozzle is located in an operative position within the neck of a fuel storage tank.

As shown in FIGS. 1 and 2 of the drawings, when the shroud 50 is in the fully extended position the arm 76 is in a position depressing the diaphragm 28 (as shown in solid lines in FIG. 2) in which position the pusher arm 36 pushes the rollers 32 out of engagement with the slot 34 releasing the plunger 18. It follows that when the shroud is in the fully extended position, the movement of the handle 16 will not result in opening of the liquid flow line. It will be apparent that the shroud 50 will assume this position when the nozzle is not in use and consequently when the nozzle is not in use, it is not possible to discharge liquid from the nozzle. Movement of the sealing ring 52 away from the seat 54 will cause the connecting rod 70 to move in a direction towards the head to cause the arm 72 to rotate the shaft 74 and thereby move the arm 76 in a direction away from the diaphragm 28. Continued movement in this direction from the position shown in FIG. 2 to the position shown in broken lines in FIG. 2 will withdraw the pusher arm 36 to a sufficient extent to permit the rollers 32 to be located within the slot 34 in the plunger to render the manual control mechanism operative to open the main valve. As shown in FIG. 4 of the drawings, the ring 52 is pushed towards the main body 12 as the filling tube 14 is moved to an operative position within the neck 80 of the filling tube of gasoline storage tank of an automobile or the like. The neck 80 has a lip portion 82 which may conveniently be lodged between the seat 54 and the ring 52 to locate the filling tube in an operative position within the neck 80. The mechanism used for moving the pusher arm 36 to and fro is adjusted so as to effect this movement in response to movement of the sealing ring 52 away from the seat member 54 to the position shown in FIG. 4 of the drawings. This is a position in which the shroud and the filling tube are operatively mounted with respect to the neck 80 of the tank. In this position any liquid discharged from the filling tube 14 must inevitably pass into the neck 80 and therefore to the gasoline storage tank. In addition, any vapour displaced by the inflow of liquid through the filling tube 14 must be discharged through the opening in the neck 80 into the closure formed within the shroud and thereby communicated to the vapour recovery passages of the head.

From the foregoing it will be apparent that the present invention provides a mechanism which prevents the discharge of liquid from the filling tube when the filling tube is not operatively located with respect to the tank which is to be filled. The mechanism also prevents the discharge of liquid from the filling tube when vapour recovery system is not operatively connected to the tank which is to be filled.

Figure 6:
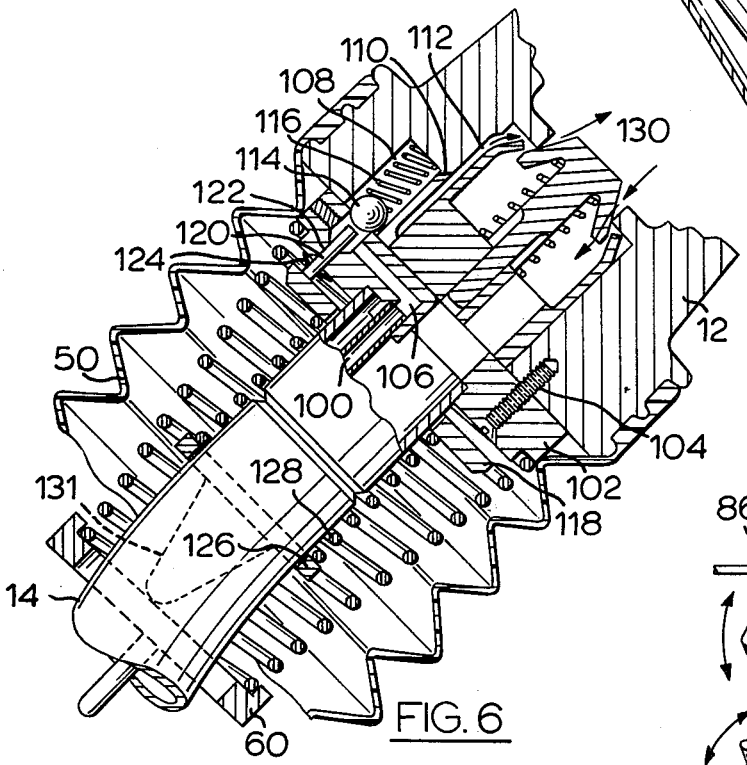
FIG. 6 is a partial side view similar to FIG. 1 illustrating a further embodiment of the present invention.

Various modifications of the present invention will be apparent to those skilled in the art. One such modification is illustrated in FIG. 6 of the drawings. FIG. 6 of the drawings illustrates a nozzle similar to the nozzle of U.S. Pat. No. 3,196,908 which includes a venturi passage 100 which has a vent opening at the lower end thereof adjacent the discharge end of the filling tube. A plate 102 is secured by means of a plurality of screws 104 to the main body portion 12 of the nozzle. The plate 102 has a passage 106 opening therethrough which forms a continuation of the passage 100. A passage 108 in the main body portion 12 communicates with the passage 106 and a passage 110 in the main body 12 extends from the passage 108 to the venturi chamber 112. A ball valve member 114 is located in the chamber 108 and is urged towards the passage 106 by means of a compression spring 116. An annular plate 118 is disposed about the filling tube 14 and has a pin 120 projecting inwardly therefrom through the passage 122 formed in the plate 102 for engagement with the ball valve 114. A gasket 124 extends around the pin. A collar 126 extends around the filling tube 14, and is spaced outwardly from the plate 118 by a compression spring 128. The collar 126 has a pair of arms 130 (only one of which is shown) projecting forwardly therefrom into engagement with the collar 60. The collar 60 engages the end plate of the shroud as previously described by means of pins 62. In use, when the shroud 50 is fully extended to the at-rest position, the plate 118 is located in the position shown in FIG. 6 of the drawings in which the pin 120 is withdrawn to permit the ball valve 114 to rest against the end of the passage 106, thereby closing the passage 106 to prevent the passage of a gas through the vent system. If, under these conditions, the nozzle is separated, flow past valve 130 will, as usual, produce a vacuum in passages 112 and 110. Normally this vacuum is negated by flow of vapour through passage 106 and past ball 114. However, with ball 114 on its seat, the vacuum is applied to damper 26 by way of passages 40 which communicate with passage 112; thus, releasing rollers 32 from notch 34 and shutting down the operating mechanism. This action is so rapid that only a very small quantity of produce will pass tube 14 before shut off. The ball valve 114 in this position operates to achieve the same effect as is achieved by the liquid rising in the tank above the open end of the vent passage in the conventional automatic nozzle structure.

When the shroud 50 is compressed to the operative position previously described, the collar 126 is moved rearwardly to compress the spring 128 which in turn moves the plate 118 inwardly of the plate 102. This moves the pin 120 inwardly of the passage 106 to force the ball valve 114 off its seat. This permits the free passage of gas through the passage 100, 106, 108 and 110 to provide a completely open vent line permitting free operation of the venturi system so that liquid may be dispensed through the nozzle.

It will be apparent that this modification illustrates an alternative method of incorporating the control mechanism for preventing the flow of liquid through the nozzle until the nozzle is operatively located within a fuel storage tank which is to be filled.

What we claim as our invention is:

1. In a dispenser nozzle having, a main body portion, a filling tube projecting from one end of said main body portion, and a liquid flow passage extending through said main body and said filling tube, the filling tube being adapted to be located within the open end of a neck of a fuel storage tank of a vehicle or the like, a control valve mechanism for controlling the flow of liquid through said liquid flow passage, said mechanism including a valve operating mechanism and latching means for releasably engaging said valve operating mechanism to render said valve operating mechanism operative when engaged by said latching mechanism and inoperative when released by said latching mechanism, a vacuum chamber in said main body, a pressure sensitive diaphragm in the vacuum chamber, means connecting the diaphragm to the latching means for moving the latching means between its operative and inoperative positions, vacuum passage means communicating between the vacuum chamber and a vacuum generating source within the body which is operative in response to the flow of fluid therethrough and a vent passage having one end opening into the vacuum chamber, the other end of the vent passage opening adjacent the end of the filling tube whereby the vacuum chamber may be vented by way of the vent passage to permit the latching means to be retained in a position in which the valve operating mechanism is operative, vapour recovery passage means formed in said main body, an extensible vapour recovery shroud mounted on said main body and having one end communicating with the vapour recovery passage means of said main body and the other end urged towards the discharge end of the filling tube, the shroud extending substantially coaxially with respect to the filling tube and having a tight seal collar at said other end thereof for engagement with the end of the filling pipe of the gas tank in use to direct vapour expelled from the tank during filling to the vapour recovery passage by way of the shroud, the improvement of;

i. a normally closed check valve mounted in the main body and having a valve member in said vent passage for opening and closing said vent passage to release said latching means when the vent passage is closed thereby, ii. resilient valve operating is disposed between said shroud and said filling tube and extending from said valve member to said tight seal collar for moving said valve member to said open position when said tight seal collar is moved a predetermined distance towards said body to form a seal with the end of the filling pipe of the gas tank or the like.

* * * * *